US006026887A

United States Patent [19]

Dykes et al.

[11] Patent Number: 6,026,887

[45] Date of Patent: Feb. 22, 2000

[54] STEERING, TENSING AND DRIVING A REVOLVING CASTING BELT USING AN EXIT-PULLEY DRUM FOR ACHIEVING ALL THREE FUNCTIONS

[75] Inventors: Charles D. Dykes, Williston; J. F. Barry Wood, Burlington; Charles R. Simon, Williston; R. William Hazelett, Colchester, all of Vt.

[73] Assignee: Hazelett Strip-Casting Corporation, Colchester, Vt.

[21] Appl. No.: 08/810,414

[22] Filed: Mar. 4, 1997

[51] Int. Cl.[7] ..... B22D 11/06

[52] U.S. Cl. ..... 164/481; 164/431

[58] Field of Search ..... 164/481, 429, 164/430, 431, 432, 479

[56] References Cited

U.S. PATENT DOCUMENTS

| | | | |
|---|---|---|---|
| 3,167,830 | 2/1965 | Hazelett et al. | 22/57.4 |
| 3,310,849 | 3/1967 | Hazelett et al. | 22/57.4 |
| 3,878,883 | 4/1975 | Hazelett et al. | 164/278 |
| 3,949,805 | 4/1976 | Hazelett et al. | 164/278 |
| 3,963,068 | 6/1976 | Hazelett et al. | 164/278 |
| 4,545,423 | 10/1985 | Platek et al. | 164/481 |
| 4,614,224 | 9/1986 | Jeffrey et al. | 164/432 |
| 4,901,785 | 2/1990 | Dykes et al. | 164/481 |
| 4,921,037 | 5/1990 | Bergeron et al. | 164/432 |
| 4,940,076 | 7/1990 | Desautels et al. | 164/452 |
| 5,000,250 | 3/1991 | Feuerstacke | 164/155.5 |

FOREIGN PATENT DOCUMENTS

| | | |
|---|---|---|
| 63-101054 | 5/1988 | Japan . |
| 1-289547 | 11/1989 | Japan . |

OTHER PUBLICATIONS

Copy of Search Report received related to corresponding European Patent Office Application No. EP 98 103605.6.

Tom Frankenfield, *Using Industrial Hydraulics*, second edition 1984, (published by Hydraulics & Pneumatics Magazine, Cleveland, Ohio), Title Page (front and back); pp. 7–7 and 7–15 to 7–17 of Chapter 7.

*Primary Examiner*—Harold Pyon

*Assistant Examiner*—I.-H. Lin

*Attorney, Agent, or Firm*—Parmelee & Bollinger, LLP; G. Kendall Parmelee

[57] ABSTRACT

Steering, tensioning and driving a revolving metallic casting belt in continuous casting machines wherein the belt travels along a generally straight casting plane P. Two two-axis robotic mechanisms are positioned at opposite ends of an exit-pulley drum, each including a "floating" housing carrying a bearing rotatably supporting a journal at the respective drum end. A drive shaft connected to one of the journals rotates the drum for revolving the belt. The robotic mechanisms adjustably position opposite ends of a rotating drum in X—X plane parallel with plane P for tensioning the belt and in Y—Y plane perpendicular to plane P for steering the revolving belt. These robotic mechanisms are controlled to operate in any of several modes: (1) "Walking-tilt" steering keeps the belt much closer to an exiting product than prior art, the belt being flatter and in better contact with the product for improving casting speed and quality. Mode (2) provides a "virtual squaring shaft" causing a drum to simulate being constrained by a rigid mechanical squaring shaft for synchronizing downstream movements of both drum ends for regularizing tension fully across a "cylindrical" casting belt. In modes (3), (4) and (5) the rigidity of the virtual squaring shaft may be "softened," or re-zeroed or eliminated, to accommodate small "frustro-conical" errors in belt manufacture. Moreover, even a small error in built-in length dimensions of a belt carriage may effectively be canceled by mode adjustments which effectively "twist" the virtual squaring shaft.

26 Claims, 9 Drawing Sheets

STEERING, TENSING AND DRIVING A REVOLVING CASTING BELT USING AN EXIT-PULLEY DRUM FOR ACHIEVING ALL THREE FUNCTIONS

FIELD OF THE INVENTION

This invention is in the field of belt-type continuous metal-casting machines having a substantially straight or flat moving-mold casting region wherein the belt or belts travel along a casting plane from an entrance into the mold region to an exit therefrom. The disclosure will proceed in terms of twin-belt casting machines, though some of the subject matter of the invention may be applied also with advantage to open-top, single-belt casting machines of the type having a substantially flat or straight, moving-mold casting region. The term "substantially flat" herein includes such gentle longitudinal curvature as may suffice to keep a travelling casting belt against backup means in the moving-mold casting region and also includes such gentle transverse curvature as may suffice to keep a travelling casting belt against such backup means, and/or against a contracting freezing product being cast.

BACKGROUND

Upper and lower casting belts in twin-belt continuous casting machines for continuously casting molten metal are relatively thin and wide. These casting belts are formed of suitable heat-conductive, flexible, metallic material as known in the art, for example such as quarter-hard low-carbon rolled sheet steel having a thickness for example usually in a range from about 0.045 of an inch to about 0.080 of an inch. These upper and lower belts are revolved under high tensile forces around a belt carriage in an oval path. During revolving in its oval path, each belt is repeatedly alternately passed around an entrance-pulley drum and an exit-pulley drum at respective entrance and exit ends of the moving-mold casting region in the machine.

The revolving upper and lower belts define a moving-mold casting region between them. This casting region is intended to be substantially defined between flat casting belts travelling from the entrance into the moving-mold region to the exit therefrom. Thus, the casting region is intended to extend from entrance to exit along a substantially flat casting plane.

The present invention deals with steering, tensioning and driving the revolving upper and lower casting belts. Therefore, to be more readily understood, this BACKGROUND will be set forth under three sub-headings:

Steering: As each highly-tensioned belt is revolving in its oval path, it inevitably tends to creep gradually edgewise in an unpredictable manner. Thus each belt must be steered individually. A belt cannot be steered by edge guidance efforts because edgewise creeping motion of a highly-tensioned, thin, metallic belt involves such large sideways (edgewise) forces that an edge of a revolving belt would crumple and tear against a futilely placed edge guide. Hence, each belt is steered by slightly tilting the axis of rotation of each exit-pulley drum. Entrance-pulley drums cannot be used for steering, because entrance-pulley drum axes must remain fixed so as to keep the mold entrance in a required predetermined cooperative relation with molten-metal infeed apparatus leading into the entrance.

Tilting-steering action of an exit-pulley drum currently is preferred to be accomplished by movements occurring in a plane which is substantially perpendicular to the casting plane.

A problem which occurs with tilting exit-pulley-drum axes by movements perpendicular to the casting plane is that such steering causes exit portions of each belt to become twisted slightly away from the casting plane. Consequenty, a newly cast slab loses support during critical moments while a downstream portion of this newly cast slab is moving along the casting region toward the exit end of the casting machine.

Tensioning: The upper and lower casting belts in a continuous casting machine wherein the belts are revolved in respective upper and lower oval paths are highly tensioned by exerting large forces for moving the axes of the upper and lower exit-pulley drums in a downstream direction. Entrance-pulley drums are not moved for tensioning purposes for reasons as already explained in regard to steering. Consequently, each belt is highly tensioned by moving the rotational axis of its exit-pulley drum by exerting large forces in a direction parallel with the casting plane for increasing slightly the distance between an exit-pulley drum and an entrance-pulley drum on the same carriage. This slight downstream movement of an exit-pulley drum continues the downstream movement required to take up the slack in a belt. Such slack is present in a newly-installed belt due to an upstream movement of an exit pulley which occurred previously to permit removal of a used belt and installation of a new belt onto the carriage.

Sometimes one edge of a casting belt is very slightly longer than the other, i.e., the belt when freely supported is very slightly frustroconical in configuration. Nevertheless, during continuous casting operation, the belt needs to be under substantially uniform high tension across the full width of the moving mold casting region.

Since each exit-pulley drum is being tilted for steering purposes in a plane substantially perpendicular to the casting plane, problems arise because this same drum also must be movable in a plane substantially parallel with the casting plane with large forces being applied in a direction substantially parallel with the casting plane for providing large tensile forces in the belt and wherein such tensile forces are substantially uniform across the full width of the casting cavity.

In certain prior-art machines as illustrated schematically in FIGS. 6A through 6F wherein there was a substantial neutral-position spacing of an exit-pulley drum from the casting plane P, as shown in FIGS. 6B and 6E, the forces involved during tilt-steering of a casting belt have caused significant diagonal stresses which in turn can cause diagonal fluting of the revolving belt. In practice, the high tensile forces involved in tilt-steering resulted in diagonal stresses in the flat reaches of the casting belt. Experience has shown that belts remain flatter, and a better product is cast, if the steering action can be minimized. Progress in this direction occurred with U.S. Pat. No. 4,940,076 of Desautels and Kaiser which disclosed a method and system achieving increased precision of steering, thereby minimizing the occurrences of and magnitudes (amplitudes) of steering motions. The method and the system invented by Desautels and Kaiser have been called "zero-point" belt position sensing and steering. However, the pattern of tilting of the exit-pulley drum in accord with their invention remained the same as occurred before their invention, namely, remained the same as shown in FIGS. 6A through 6C.

Belt-driving: During some recent years in continuous casting machines wherein the upper and lower casting belts are revolved in respective oval paths around entrance and exit-pulley drums, it had become usual practice to drive the revolvable casting belts by applying rotary driving force to the entrance-pulley drums. It had been preferred to drive the upper and lower entrance-pulley drums because the interiors of hollow exit-pulley drums were occupied by large "squaring shafts" (often being tubular "squaring tubes") of the prior art, rendering driving of those exit-pulley drums hardly feasible. Such squaring shafts were described in U.S. Pat. Nos. 3,949,805 and 3,963,068 of Hazelett, Wood and Carmichael, assigned to the same assignee as the present invention. Such prior-art squaring shafts were designed to ensure that the exit-pulley drums remained square with the carriage frames of the casting machine while these exit-pulley drums were being moved upstream and downstream in the direction parallel with the casting plane as described above.

A problem with revolving each belt around entrance and exit-pulley drums by rotatably driving its entrance-pulley drum arose from the fact that the belt was being pulled along its return (upstream) travel from exit to entrance. Conversely, during its downstream travel along the casting region, the driving force being applied to the belt by the rotatably driven entrance-pulley drum tended to reduce belt tension in areas of the belt immediately downstream from the entrance-pulley drum. These casting-belt areas near the entrance of the casting machine are very critical in the performance of a casting machine, because incoming molten metal flowed into the entrance is initially beginning to solidify against such belt areas. Initial solidification creates easily disturbed thin layers adjacent to the revolving casting belts. Undesired thermal belt distortions are more likely to occur in areas near the entrance where belt tension is reduced due to belt-driving force exerted by an entrance-pulley drum. Such thermal distortions may disturb and interfere with initial solidification of molten metal, thereby adversely affecting surface characteristics and/or overall qualities of a resultant continuously cast product.

Hence, it is desirable to drive the exit pulleys. Exit-pulley drive entails elimination of the prior-art squaring shafts from inside of the exit-pulley drums in order to permit attachment of a driving stub shaft to one end, the inboard end, of each exit-pulley drum for rotatably driving each exit-pulley drum. Also, a stub shaft is attached to the outboard end of each exit-pulley drum. The stub shafts projecting from each end of each exit-pulley drum serve as journals 63 and 64. Yet, the need for the "squaring" function remains.

SUMMARY

It is an object of the present invention to overcome or substantially solve the complex problems of simultaneously steering, tensioning and driving upper and lower revolving belts in a twin-belt continuous casting machine by enabling the exit-pulley drums to be used for performing all three of (1) steering and (2) tensioning and (3) belt-driving in a practical and successful method and apparatus.

Since the "squaring shaft" ("squaring tube") is to be eliminated from each exit-pulley drum, an object of this invention is to achieve a virtual equivalent of a mechanical "squaring" function by novel mechanisms which avoid the need for any squaring shaft or squaring tube.

In accordance with the present invention in one of its aspects in twin-belt continuous casting machines wherein upper and lower flexible, metallic casting belts are revolved in upper and lower oval paths around respective entrance and exit-pulley drums and wherein the entrance and exit-pulley drums are near entrance and exit ends of a machine for defining a moving-mold casting region extending along a casting plane from entrance to exit with the casting plane being between spaced, opposed portions of the revolving belts, all functions of steering, tensioning and driving of a revolving casting belt are accomplished by apparatus operatively associated with each exit-pulley drum. This apparatus includes a first steering assembly for tilting a first end of the exit-pulley drum away from the casting plane only when a belt requires steering in a first direction. This tilting by the first steering assembly is in a plane perpendicular to the casting plane. There is a second steering assembly for tilting a second end of the exit-pulley drum away from the casting plane only when the belt requires steering in a second direction opposite to the first direction, and this tilting by the second steering assembly is in a plane perpendicular to the casting plane. Steering control apparatus for the first and second steering assemblies keep at least one of the first and second exit-pulley-drum ends proximate to the casting plane at all times. The steering-tensioning-driving apparaus also includes a first tensioning assembly applying a first force acting parallel with the casting plane in a direction away from the entrance, with this first force being applied to the first end of the exit-pulley drum for moving the first end away from the entrance in a direction parallel with the casting plane for tensioning the belt. A second tensioning assembly applies a second force acting parallel with the casting plane in a direction away from the entrance, with this second force being applied to the second end of the exit-pulley drum for moving the second end away from the entrance in a direction parallel with the casting plane for tensioning the belt. Tensioning control apparatus coordinated with the steering control apparatus adjusts relative magnitudes of the first and second forces for optimizing tensioning and steering of the belt. Rotary drive mechanism connected to the first end of the exit-pulley drum rotates the exit-pulley drum for revolving the belt in an oval path around the exit-pulley drum and around an entrance-pulley drum with the belt travelling along the casting plane in a direction from the entrance to the exit.

BRIEF DESCRIPTION OF THE DRAWINGS

Other objects, aspects, features and advantages of the present invention will become more fully understood from the following detailed description of the presently preferred embodiment considered in conjunction with the accompanying drawings, which are presented as illustrative and are not necessarily drawn to scale and are not intended to limit the invention. Corresponding reference numbers are used to indicate like components or elements throughout the various Figures. Large outlined arrows point "downstream" in a longitudinal (upstream-downstream) orientation and thus these arrows indicate the direction of product flow from entrance to exit and, normally, the direction of flow of liquid coolant (primarily water) applied to a reverse side (inside) surface of each revolving casting belt. Simple straight one-line arrows show the direction of belt revolution.

FIG. 2 shows relationships involved for explaining two-axis steering and tensing movements involved in methods and apparatus embodying the present invention. This figure shows schematically force actuators which are shown acting correctly in concept but which are not in their real positions nor shown with their real connections. Also, this schematic illustration does not show how the true (actual) steering pivot axis shifts back and forth from end to end of the exit-pulley drum, nor does it show how the true steering pivot axis advantageously is positioned very close to the casting plane P for achieving "walking-tilt" steering as is shown in FIGS. 7A, 7B and 7C.

In FIG. 4 the lower belt is shown partially broken away, and an inboard bearing is shown partially sectioned.

FIGS. 6A to 6C illustrate (exaggerated) prior-art "see-saw" tilting steering action wherein tilting of the lower exit-pulley drum occurred in a plane substantially perpendicular to the casting plane and wherein that tilt center axis (pivot axis) of this see-saw tilting action is indicated by a small circle. In the neutral steering position, shown in FIG. 6B, the entire exit-pulley drum always was spaced a substantial distance away from the casting plane.

DETAILED DESCRIPTION OF THE PREFERRED EMBODIMENT PRESENTED IN ITS EVOLUTION FROM PRIOR ART

Figure 1:
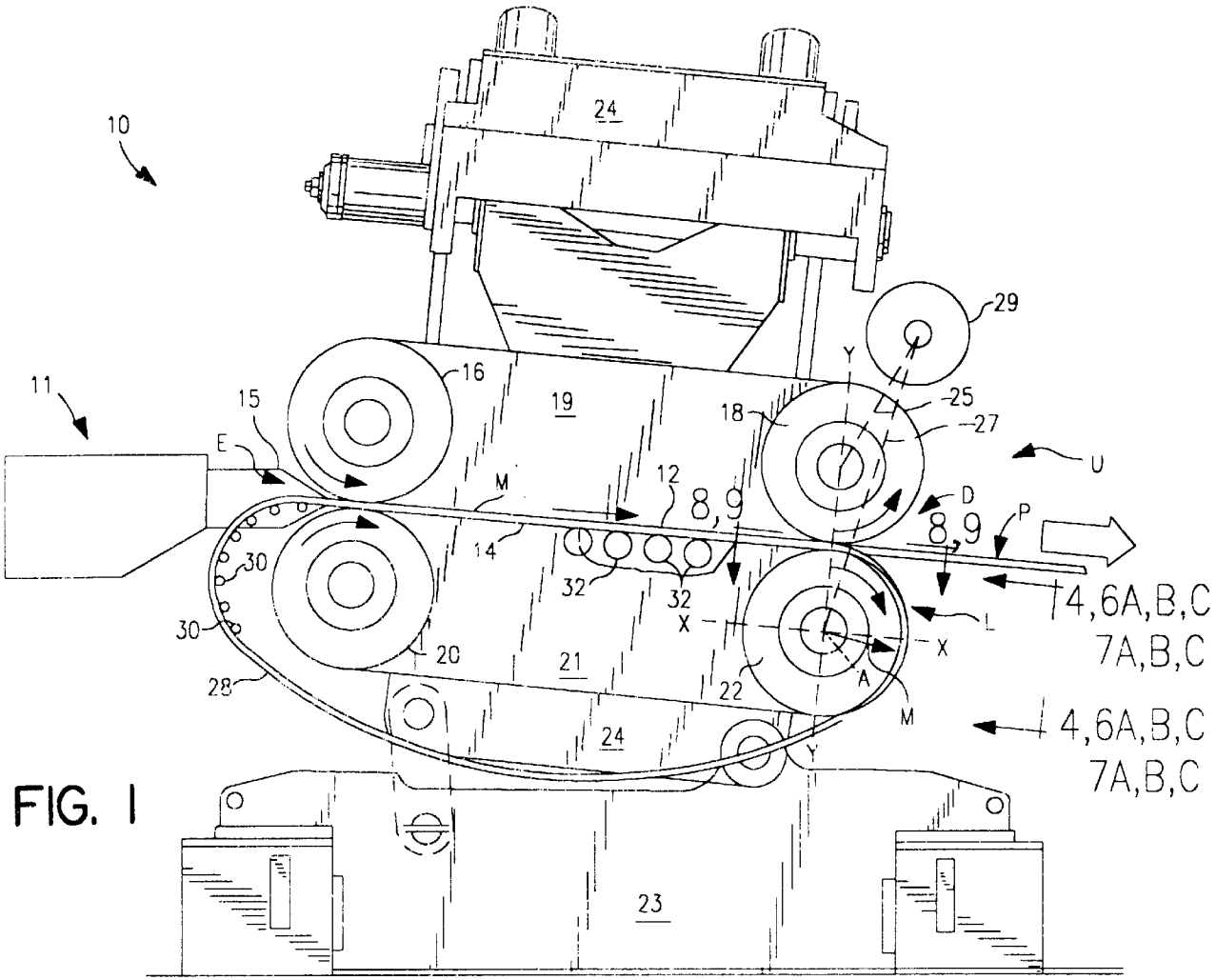
FIG. 1 is a side elevational view of a twin-belt continuous metal-casting machine, shown as an illustrative example of a belt-type continuous metal-casting machine in which the present invention may be employed to advantage.

In FIG. 1 is shown a belt type of continuous casting machine, illustratively shown as a twin-belt caster 10. Molten metal is fed into the entry end E by infeed apparatus 11, as known in the twin-belt caster art. This molten metal enters into a moving casting mold region M defined between upper and lower casting belts 12 and 14, respectively.

Cast metal product P issues from the downstream or exit end D of the casting machine 10. (P is also denominated spatially as being coincident with the pass line or casting plane.) The casting belts 12 and 14 are supported and driven by means of upper and lower carriage assemblies U and L respectively. The upper carriage U, as shown in this embodiment of the present invention, includes two main roll-shaped pulley drums 16 (nip-or entrance-pulley drum) and 18 (downstream or steering, tensioning, driving, exit-pulley drum) around which the upper casting belt 12 is revolved as indicated by arrows. These pulley drums are mounted in an upper carriage frame 19 for example of welded steel construction.

Similarly, the lower carriage L, in the embodiment of the invention as shown, includes nip- or entrance-pulley drum 20 and downstream or steering, tensioning and driving exit-pulley drum 22, around which the lower casting belt 14 is revolved, as indicated by arrows. These pulley drums are mounted in a lower carriage frame 21. Both upper and lower carriages U and L are mounted on a machine frame 24 which in turn is mounted on a base 23. The casting plane P defined by this moving mold region M usually is inclined downwardly slightly in the downstream or exit direction, as is shown in FIG. 1.

In order to drive the casting belts 12 and 14 in unison, the exit-pulley drums 18 and 22 of both the upper and lower carriages respectively are jointly driven in opposite directions at the same rotational speed through universal-coupling-connected upper and lower drive shafts 25 and 27, shown schematically, which in turn are driven by a mechanically synchronized drive 29 as is known in the art, shown schematically.

Two laterally spaced edge dams 28 typically travel around rollers 30 to enter the moving casting mold region M, defined between the casting belts 12 and 14 (only one edge dam shows in FIG. 1).

For present purposes, the two carriages L and U may be regarded as mirror images of each other with respect to the casting plane P, i.e., the plane extending throughout the width and length of the product P and the casting mold region M. Most of the reference numbers henceforth apply identically to the components of both carriages and in some cases to both outboard and inboard parts when these parts are identical. The description will be in terms of the equipment on the lower carriage L.

Figure 2:
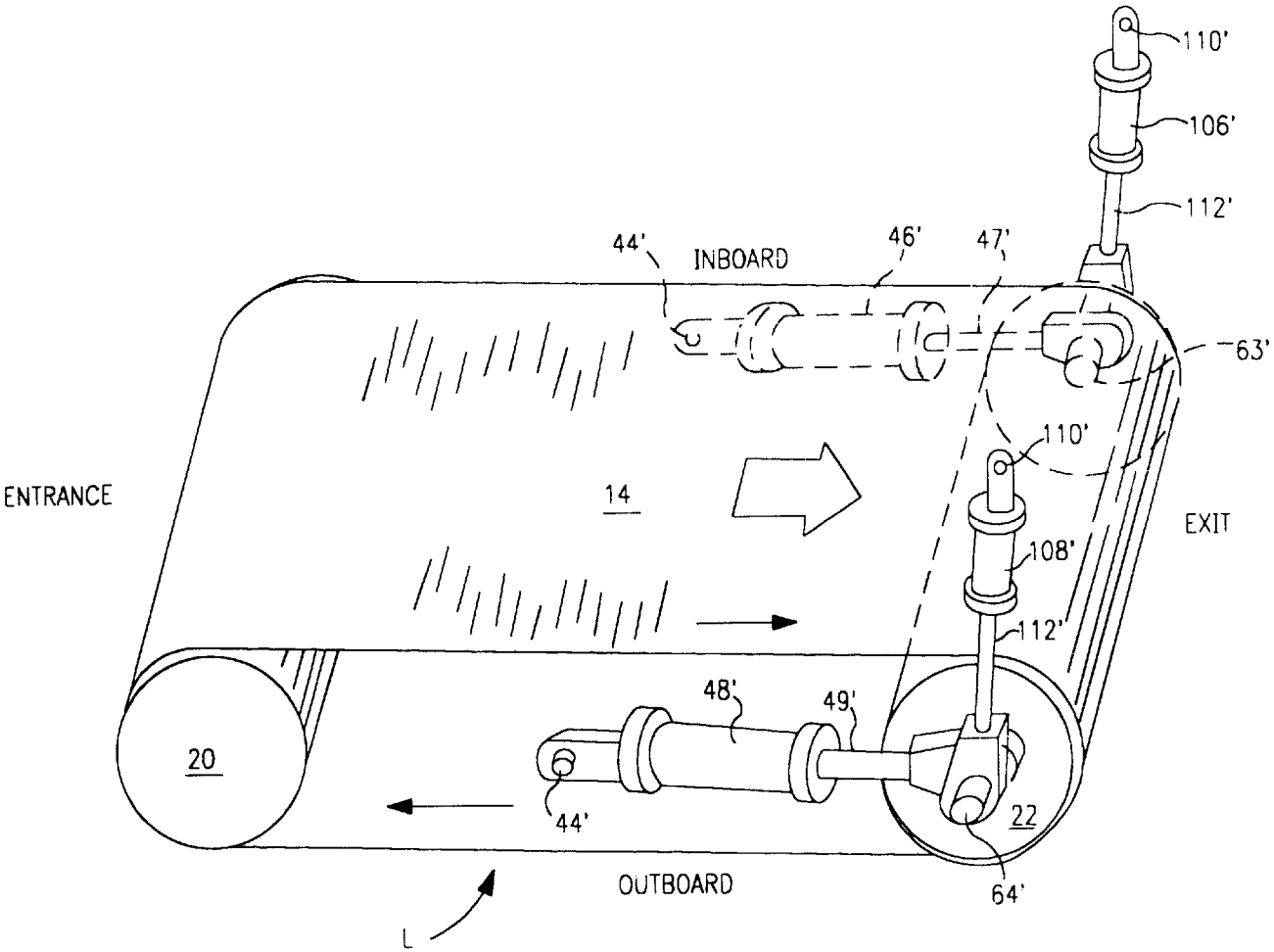
FIG. 2 is a schematic perspective view from above and somewhat downstream of a lower revolving casting belt with its entrance- and exit-pulley drums. The lower carriage is omitted from FIG. 2 for clarity of illustration.

FIG. 2 for purposes of explanation shows in simplified schematic form the interrelated functions of steering and tensioning in accord with this invention.

Two-axis robots, i.e., mechanical-positioning assemblies each comprising two force actuators, are applied via "floating" housings to each journal of a driving, exit-pulley drum 22. Thus, each journal is adjustably positioned in two coordinate directions by the two-axis robots. These two coordinate directions lie in planes X—X and Y—Y (FIG. 1) respectively parallel with and perpendicular to the casting plane P. Two-axis robots permit the desired drive of the exit-pulley drums 18, 22 by drive shafts 25, 27, each acting through a universal connection 67 (FIG. 4), while at the same time solving several other problems. The robots comprise the actuating cylinders, levers and spherical bushings shown most clearly in FIG. 3 but which are conceptually better understood as illustrated schematically in FIG. 2. The two-axis robotic mechanisms are mechanically independent. Their coordination occurs by means of an electrical controller which can operate in any of several control modes.

Figure 3:
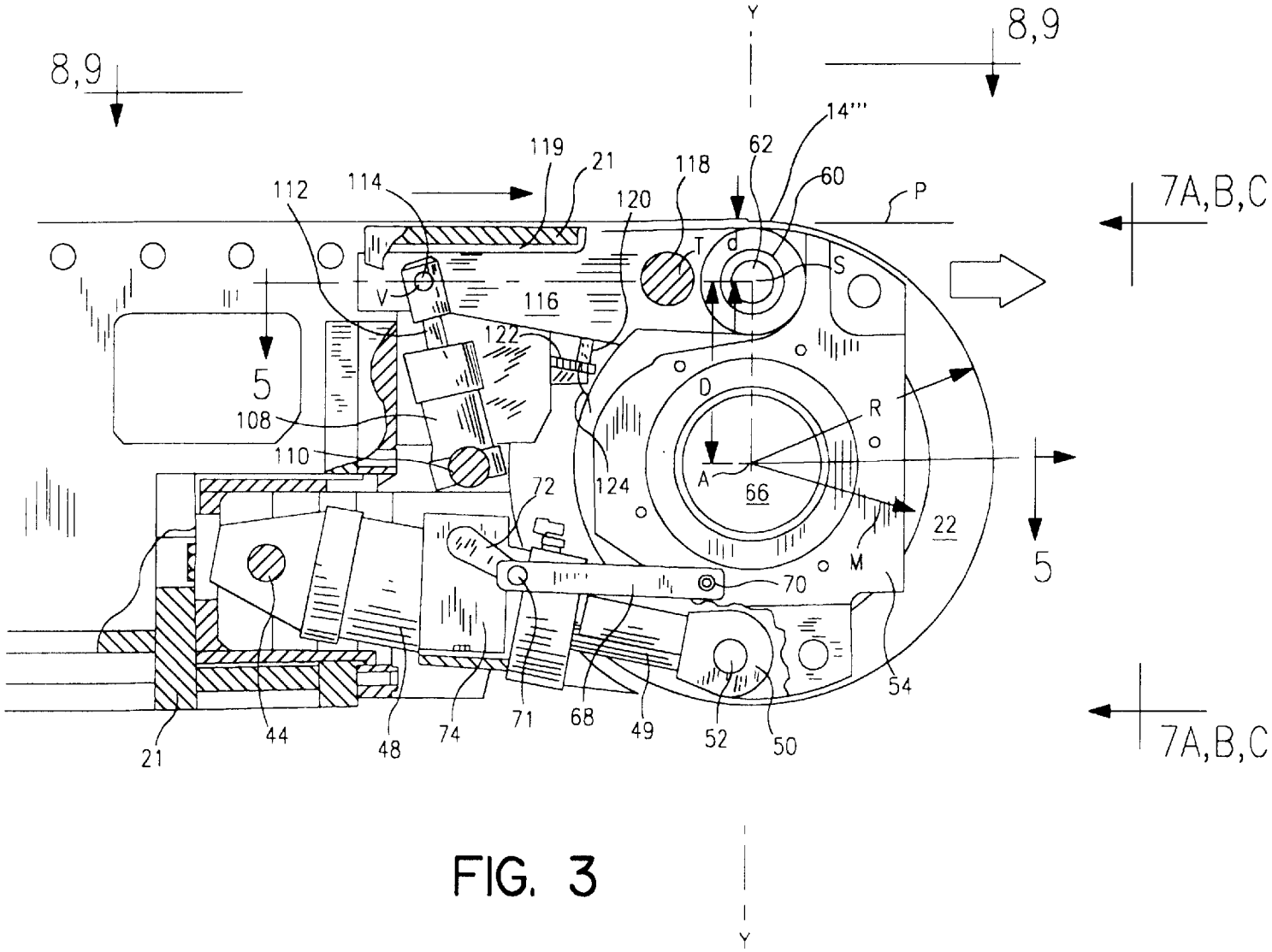
FIG. 3 is a partially sectioned, enlarged side elevational view of an exit end portion of the lower belt carriage of the machine seen in FIG. 1 for showing apparatus embodying the invention. The viewpoint is indicated by line 3—3 in FIG. 4.
Figure 4:
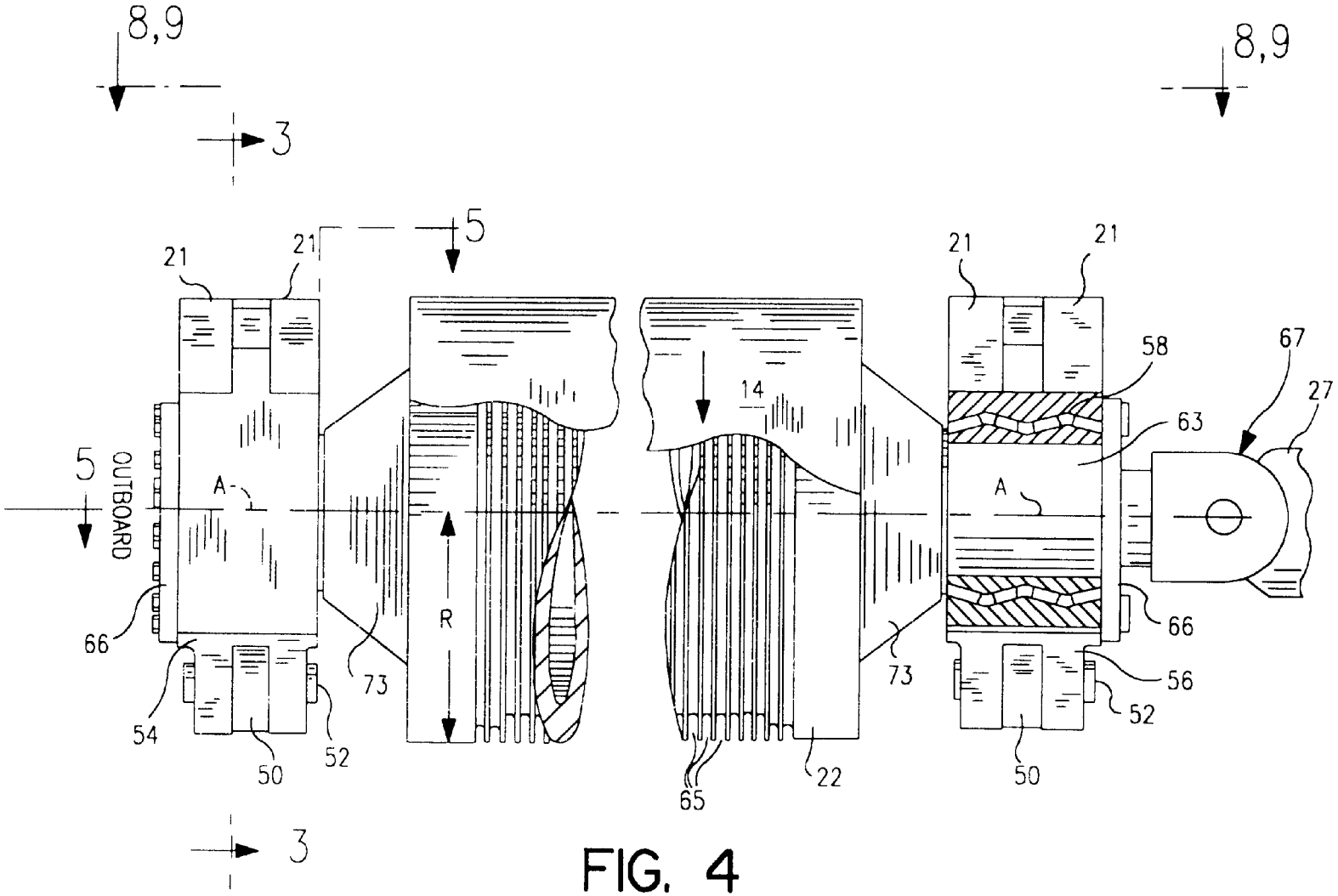
FIG. 4 is an elevational sectional view of the lower exit-pulley drum as seen looking upstream from position 4—4 in FIG. 1.
Figure 5:
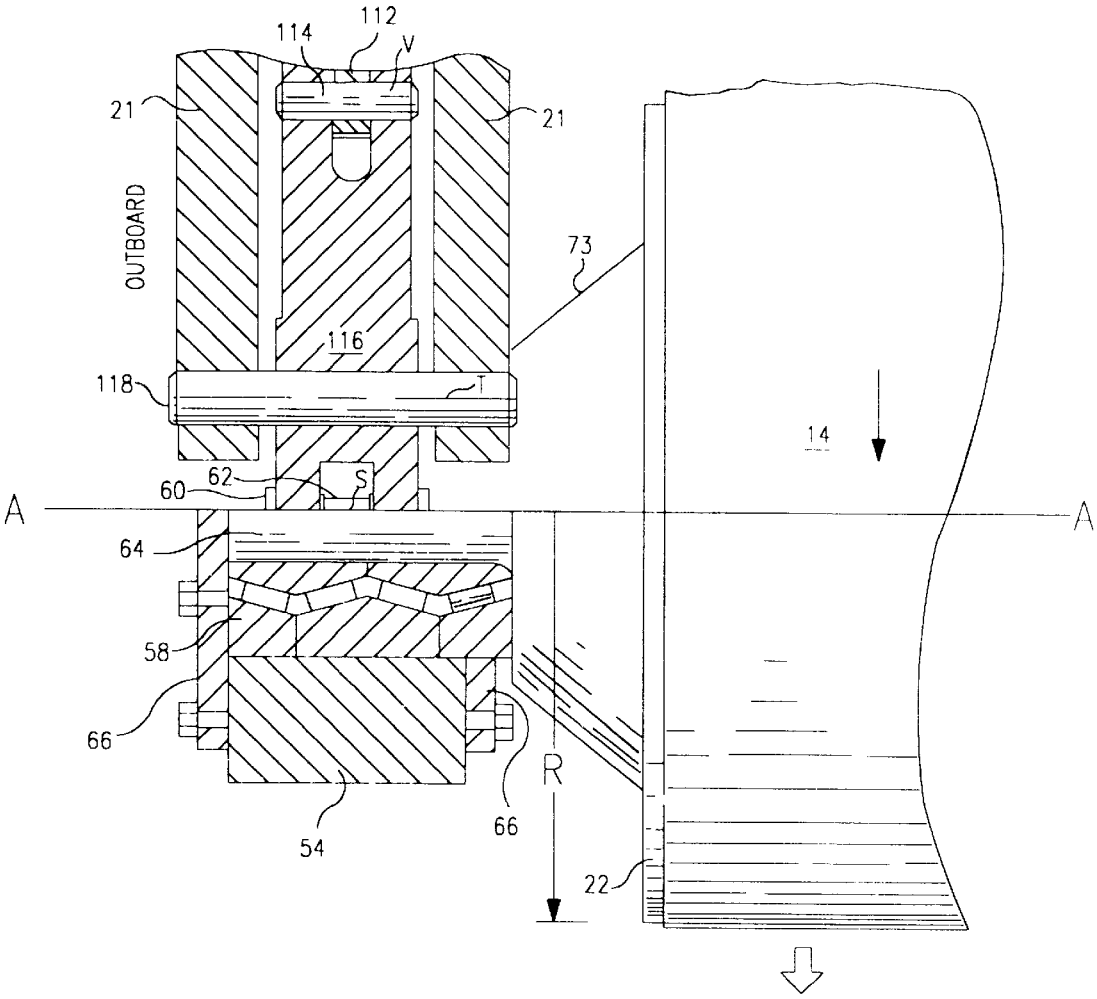
FIG. 5 is an enlarged, partially sectioned plan view of one end of the exit portion of a lower carriage as viewed from above an outboard side of the lower carriage. The viewpoint of FIG. 5 is indicated by line segments 5—5 in FIGS. 3 and 4.
Figure 9:
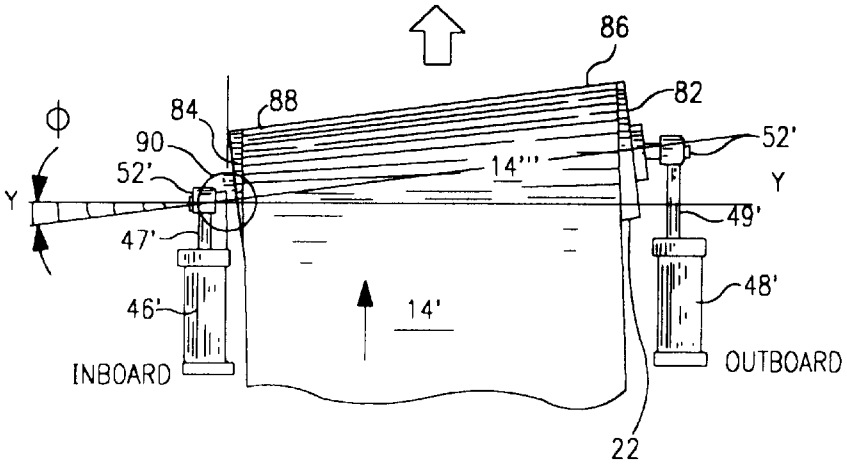
FIG. 9 is a simplified top plan view, similar to that of FIG. 8, illustrating the position of this exit-pulley drum while it exerts regular operating force for tensioning uniformly against the crooked or "frustro-conical" casting belt shown in FIG. 8.
Figure 8:
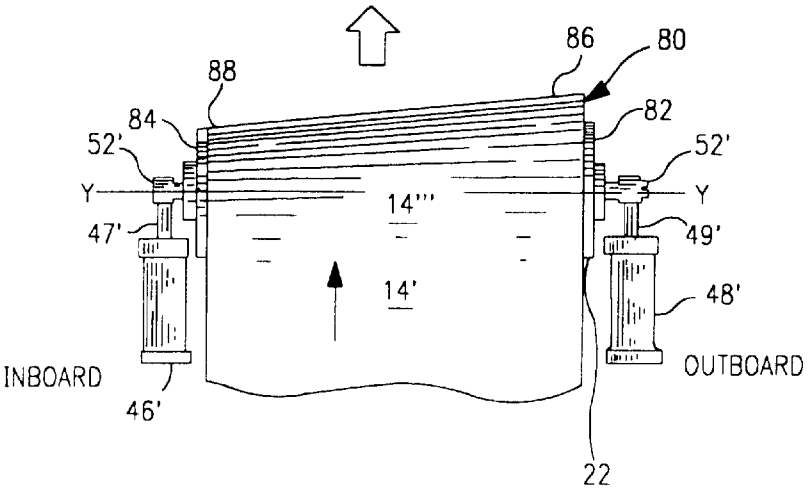
FIG. 8 is a simplified top plan view of the lower exit-pulley drum seen from above with the upper carriage removed, illustrating the exit-pulley drum as it first touches an initially crooked or "frustro-conical" belt when longitudinal tension is beginning to be applied to the belt. The viewpoint of FIG. 8 is indicated in FIGS. 1, 3 and 4 by line 8—8. A frustro-conical belt configuration is shown greatly exaggerated for purposes of explanation. The belt-tensioning cylinders are not shown in their real positions, and the real linkage is not shown.

Belt tensioning. FIG. 3 is a side view of the outboard side of the lower carriage L at the exit end. An outboard tension cylinder 48 (FIG. 3) and an inboard tension cylinder 46 (not shown in FIG. 3) are schematically illustrated in FIGS. 2, 8 and 9 as 48' and 46', respectively. These tension cylinders 48 and 46 are pivotally anchored at 44 to a respective carriage frame. Each cylinder acts via a respective piston rod 49 (and 47 not shown in FIG. 3) upon a first spherical bushing 50 mounted on a pin 52 and so force is applied upon respective movable housings 54 and 56 and finally upon tapered roller bearings 58 (FIG. 4). This tension force serves to swing the respective movable housings 54 and 56 about second spherical bushings 60 and pins 62 and so pushes downstream the outboard journal 64 (FIG. 5) and inboard journal 63 (FIG. 4). Thus the exit-pulley drum 22 is forced in a downstream direction in plane X—X against the belt 14 for tensioning it. Bearing seal caps 66 seal the tapered roller bearings 58.

Figures 7A, 7B, 7C:
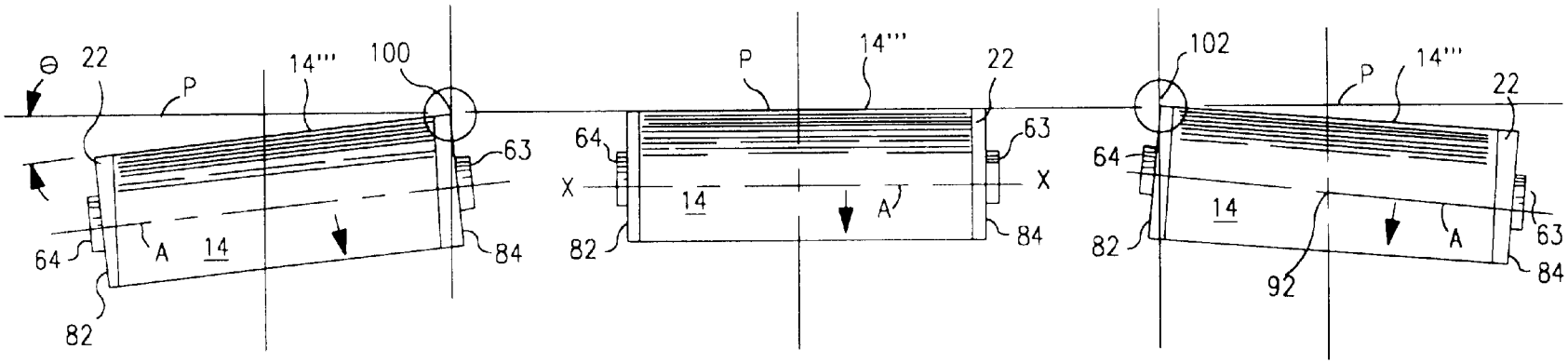
FIGS. 7A, 7B, and 7C illustrate (exaggerated) the advantageous walking-tilt steering action provided by a machine embodying the present invention. These views are as seen from the position 7A,B,C—7A,B,C in FIGS. 1 and 3.

It is to be noted that movable housings 54 and 56 are "floating" in relation to the carriage frame 21. Spherical bushings 50 and 60 enable these housings to "float" in position. The second spherical bushing 60 with its pin 62 provides a movable fulcrum, i.e., steering pivot axis 102 (FIG. 7C). The first spherical bushing 50 with its pin 52 applies force (effort) to the housing 54 causing the housing to swing like a lever about the second spherical bushing 60 which is acting as a fulcrum. Thus, outboard and inboard floating housings 54 and 56 are levers of the "second class" with a fulcrum at 60, 62 and with effort applied at 50, 52 and with the tapered bearings 58 and their respective journals 64 and 63 being the "load" located between the fulcrum and the effort. (A second-class lever has the "load" positioned between the fulcrum and the applied effort.) The drive shaft 27 is connected by a universal joint 67 (FIG. 4) to the inboard end of the inboard journal 63. The exit-pulley drum 22 in FIG. 4 is shown having grooves 65 through which liquid coolant can flow as known in the art.

In order to provide a shiftable steering pivot axis 100 (FIG. 7A) and 102 (FIG. 7C) located at opposite ends of the exit-pulley drum and also being positioned very close to the casting plane P, the axis S of the second spherical bushing 60 with its pin 62 is located in the Y—Y plane (please also see this Y—Y plane in FIG. 1), and this axis S is located at a distance D (FIG. 3) from the axis A of the exit-pulley drum, wherein this distance D is at least about 70 percent of the radius R of the exit-pulley drum. In other words, as will be appreciated from studying the advantageously compact mechanical arrangement shown in FIG. 3, the axis S is positioned as close to the casting plane P as is reasonably possible while allowing for necessary physical size of a steering lever 116 (which is a lever of the first class) and which carries and moves the movable bushing and pin 60, 62. In the neutral steering position as is shown in FIG. 3 (and also in FIG. 7B), all three axes: the steering axis S, the axis T of a fixed pivot 118 for steering lever 116, and the axis V of a pivot connection 114 between steering lever 116 and a piston rod 112 of a steering-actuation cylinder 108 are aligned in a plane S-T-V which is parallel with casting plane P, i.e., is uniformly spaced only a small distance d from the plane P, wherein distance d is equal to or less than about 30 percent of exit-pulley drum radius R.

A squaring shaft or some substitute therefor is needed in the first place in order to prevent misalignment of a tension-pulley drum during the transport of the entire pulley drum 22 downstream toward the exit end to the position wherein it exerts tension against a casting belt 14. As explained above, the pulley 22 is moved by two cylinders or force actuators, one at either end of the pulley, exerting the tensioning forces on the belts. If one end of an exit-pulley drum were to be moved downstream much ahead of the other end, then binding or interference could occur between the pulley drum and machine parts located near to the pulley-drum ends.

The SUMMARY pointed out that the "squaring shaft" advantageously is eliminated from the exit-pulley drums 18 and 22. Inviting attention to FIG. 4, it is noted that the exit-pulley drum 22 is shown hollow and empty. Both ends of this hollow cylinder 22 are closed by rigid truncated conical end bells 73 welded onto the drum 22 with the journals 63 and 64 being rigidly integral with these end bells 73.

To prevent the above-described undesired downstream over-travel of one pulley-drum end relative to the other pulley-drum end, the present invention provides other means for coordinating the tensioning movement of the pairs of tension cylinders 46, 48 that operate on inboard and outboard sides of each carriage U and L. We have found it to be possible and highly advantageous to eliminate a prior-art torsionally rigid mechanical squaring tube or shaft by electrically commanding and controlling the motion of tension cylinders 46, 48, thereby commanding and controlling also the motions of the inboard and outboard ends (journals) 63, 64 of exit-pulley drums 22, 18.

Hydraulic liquid flow and pressure to tension cylinders 46 and 48 is electrically controlled so as to extend evenly the cylinders at both exit pulley-drum ends 63 and 64. The liquid pressure within each cylinder 46, 48 is in proportion to the force being exerted by the respective cylinder. This pressure within each cylinder is measured by a suitable transducer as known in the art of hydraulic cylinder and piston control. The resulting pressure-measurement electric signal is sent to an electrical controller (not shown).

In order to determine the downstream (X—X-plane) position of the outboard (FIG. 3) and inboard (FIG. 4) pulley-drum ends 64 and 63, there are links 68 (only one is seen in FIG. 3) pivotally attached at 70 to the respective movable housings 54 and 56. Each link 68 is pivotally attached at 71 to an arm 72 of a position-sensing potentiometer 74. Thus, each sensor 74 measures the extension of its associated hydraulic-cylinder force applicators 46, 48 and transmits a position signal to the electrical controller. This electrical controller is a programmable logic controller operated with software utilizing a proportional integral-differential program. This controller is responsive to the respective signals for liquid pressure and X—X-plane positioning of the pulley-drum ends. The details of such proportional integral-differential programs are known to those skilled in the art of process controllers. In the illustrative embodiment of the invention there is a stroke-controlled solenoid valve as described by Tom Frankenfield on page 52 of the book he prepared entitled *Using Industrial Hydraulics,* second edition (published 1984 by *Hydraulics & Pneumatics* magazine of Cleveland, Ohio 44114).

Frustro-conical belts present a problem in the design of tensioning mechanisms. Frustro-conical shapes of casting belts occur despite reasonable precautions being taken in manufacture of the belts so as to avoid such non-cylindrical shapes. In the prior-art design of Hazelett twin-belt casting machines, it was supposed that an exit pulley-drum 22 or 18 which is being used for tensioning a revolving casting belt should always be constrained to remain square to the carriage, and that it was an appropriate function to force the belt 14, 12 to conform itself by changing from frustro-conical to cylindrical shape as required by the dominance furnished by the accurate rigidity of the tension-applying exit-pulley drum. This theory of forcing a frustro-conically shaped belt to stretch into a cylindrical shape was believed to be reasonable and suitable, since under some former conditions of operation, a belt was continually incrementally stretched by a very small amount with each successive revolution, and so the stretched belt was brought into cylindrical conformity and accuracy. However, we recently have changed our view in regard to incremental belt-stretching occurring during casting operations. We now believe that better practice is to operate a machine 10 so that belt stretching generally does not occur during continuous casting operation.

In FIG. 8, a top view, the exit-pulley drum 22 is shown positioned square to the lower carriage. A belt 14' shown on the pulley drum 22 is not square (not cylindrical) of itself; its frustro-conical shape (conicalness or error of squareness) is represented as a gap 80, here shown much exaggerated for purposes of explanation. Longitudinal tension in the belt margin near pulley-drum end 82 would be absent or else less than optimum, while tension in the belt margin near the opposite pulley-drum end 84 would as a result be more than optimum. Perhaps tension in the margin near end 84 would become enough more than optimum to damage the belt 14' even if the tension were gradually increased.

Surprising recent observations have taught that it will be better practice to conform the machine to the belt. Using the hardware and general control strategy already described, a suitable program can result in an operation of each exit-pulley drum 22 and 18 which amounts to providing a "virtual squaring shaft" which can perform in any manner that any solid mechanical squaring shaft can, but in addition a virtual squaring shaft can perform more functions in advantageous ways not possible with any solid mechanical squaring shaft. Suitable software results in any of five operating modes, two of which are relevant here. To list all five: (1) the virtual squaring shaft can present itself as entirely rigid as described above. (2) In this state of being square to the carriage, an exit-pulley drum can be used to enable the leveling or conditioning of a casting belt right on the carriage. Such leveling or conditioning of a belt requires the use of additional equipment, namely a nest of small-diameter belt rollers as shown in U.S. Pat. No. 4,921,037 of Bergeron, Wood and Hazelett which is incorporated herein by reference and assigned to the same assignee as the present invention.

Again, (3) the virtual squaring shaft can present itself without "torsional rigidity" in order to accommodate a crooked or frustro-conical belt wherein one margin of the belt is longer than the other. It achieves this accommodation to non-cylindrical belt shape through exerting even pressure toward both margins of the belt. Or (4) a virtual squaring shaft can be set up to be of any virtual torsional rigidity between zero and practically infinite, in order best to accommodate frustro-conical belts when problems of steering are also considered. Finally (5) the virtual torsional shaft's inherent initial state of zero angular alignment can in effect be "skewed" a little in order to compensate for any small machining errors in the length of the entire carriage assembly U or L of casting machine 10 as between the inboard and outboard sides of the respective carriages.

To return to mode (3) above, an initial belt crookedness or initial frustro-conical shape of belt is shown in FIG. 8 as exaggerated. It is a matter of slightly differing lengths of the two margins, which may be inadvertently introduced during belt manufacture. Such frustro-conical shape presents an undesirable operating condition, since the lightly tensed margin 86 may not have enough tension to maintain its flatness during the expansive heat of casting, while the more highly tensed margin 88 may be overstressed, stretched beyond its yield strength and lose its flatness. There may also be problems of steering the belt, that is, of preventing sideways drift as the belt courses around the two pulley drums on its carriage.

To meet these problems, the accommodative mode of tension application (3 above) compensates for slight error in the relative lengths of the two edges of a casting belt. That is, this mode in its simplest form provides to the belt a uniform force across a wide casting belt, even though the belt may be slightly frustro-conical, thereby having one of its edges 86 a bit longer than the other 88, as opposed to being "cylindrical."

Assume that the inboard cylinder 46', in starting to tense a casting belt 14', causes forceful contact first at point 88 in FIG. 8. (To be accommodative to actual belt shape, outboard tension cylinder 48' is permitted to extend farther than the inboard cylinder 46' so that the outboard cylinder catches up to the belt at point 86 of FIG. 9 until a uniform predetermined force is exerted on the belt equally by both cylinders 46' and 48', resulting in relatively equal tension across a belt. The axis of the exit-pulley drum 22 now is turned about circled region 90 at an angle $\phi$ (shown much exaggerated) to the longitudinal dimension of the carriage. The resultant equality of tension differs from the prior art insofar as we have discovered that small errors in fabricating the casting belts are successfully accommodated in this way, while no other problems are introduced. That is, instead of arranging for the carriage to dominate a belt, a belt is allowed to dominate at least partially the operation of the carriage.

As mentioned under mode (4) above, a virtual squaring shaft can be set up to be of any effective torsional rigidity between zero and practically infinite. Within this wide range of control from accommodation to extreme rigidity, a compromise is attained between fully accommodative belt tensioning and the zero accommodation afforded by a rigidly squared pulley drum. This wide range of control is at times useful in properly steering an irregular casting belt.

With a virtual squaring shaft, the two-axis robotic mechanisms are controlled to cause the pulley to act as though constrained by a rigid mechanical squaring shaft, whereby the longitudinal movements of both ends of the pulley are synchronized, thereby regularizing the exertion of tension upon a cylindrical casting belt. This control mode also enables the leveling of a belt right on the casting machine with greater effective rigidity than would normally be available in a mechanical squaring tube or shaft. Variantly, the rigidity may be electrically "softened," or re-zeroed or eliminated, in order to accommodate small errors in belt manufacture. Again, even a small error in the built-in dimensions of length of a casting carriage may be effectively canceled by electrical adjustment which effectively "twists" inelastically the partly electrical virtual squaring shaft.

Figures 6A, 6B, 6C:
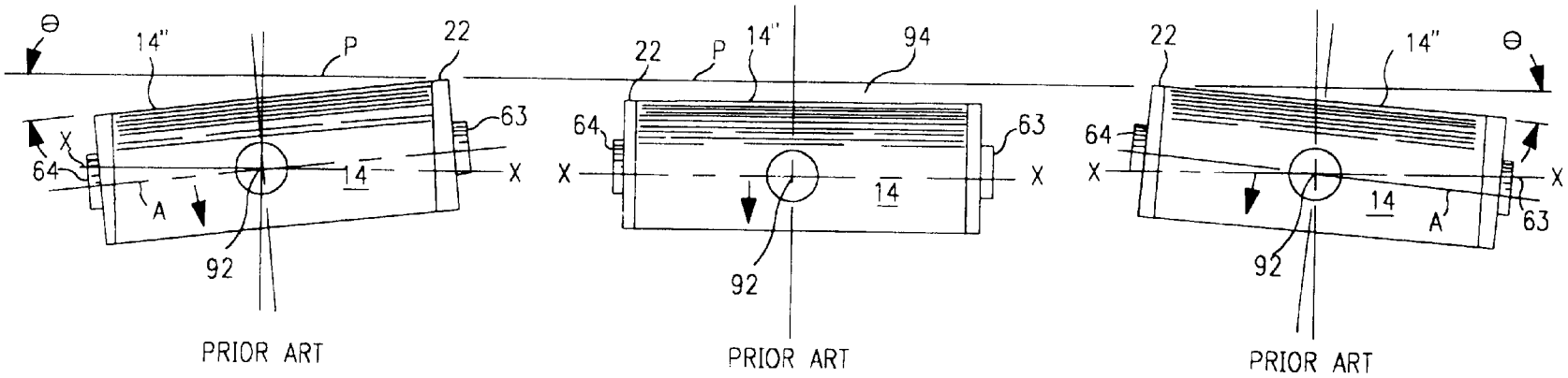
FIGS. 6A, 6B, and 6C illustrate prior art. They are elevational views of the downstream or exit end of a prior-art belt-type casting machine. These views of a prior-art machine would be obtained by looking in the upstream direction from a plane such as the plane 6A,B,C—6A,B,C in FIG. 1. These

Prior-art see-saw belt steering by transverse tilt (FIGS. 6A, 6B, 6C) is steering by tilting through an angle $\theta$ a pulley-drum tilt-axis 92-in-a-circle about a middle diameter in a plane Y—Y which is perpendicular to the casting plane P. The Y—Y plane also is perpendicular to the X—X plane in FIG. 1. In this prior-art see-saw steering, the exit-pulley drum 22 as shown in its neutral steering position in FIG. 6B is spaced a substantial distance away from the casting plane P by a spacing 94.

Because of this substantial prior-art neutral-position spacing 94 of the exit—pulley drum from the casting plane P, a portion of the belt near the exit always deviated substantially from the casting plane, thereby depriving a newly cast slab of support during critical moments while a downstream portion of this newly cast slab is moving along the casting region toward the exit end D of the casting machine, as was mentioned in the background.

Various methods and apparatus for providing the prior-art transverse-tilt steering in various casting machine configurations are shown in U.S. Pat. Nos. 3,036,348, 3,123,874, 3,142,873, 3,167,830, 3,228,072, 3,310,849, 3,878,883, 3,949,805, and 3,963,068, all assigned to the same assignee as the present invention. The latest prior art is shown schematically in FIGS. 6A, 6B and 6C.

Figure 6F:
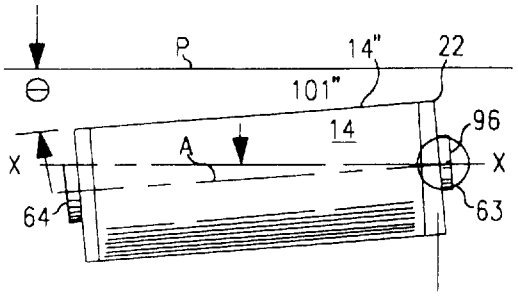
PRIOR ART FIG. 6F
FIGS. 6D, 6E and 6F illustrate earlier prior art than shown in FIGS. 6A to 6C, and they are similar in viewing orientation to FIGS. 6A, 6B and 6C. These figures illustrate (exaggerated) an early prior-art type of tilting steering action wherein the tilting occurred in a plane substantially perpendicular to the casting plane and wherein the tilting was done about a tilt axis (indicated at the center of a small circle) located at one end of an exit-pulley drum. This early prior-art steering was called "pump-handle—tilt" steering.
Figure 6E:
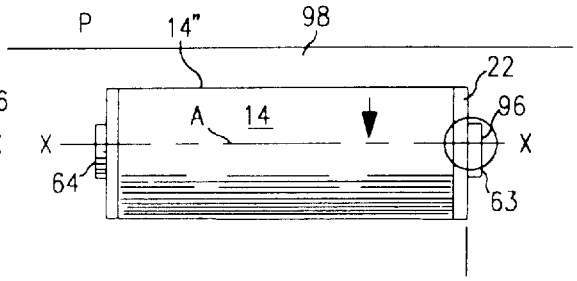
PRIOR ART FIG. 6E
Figure 6D:
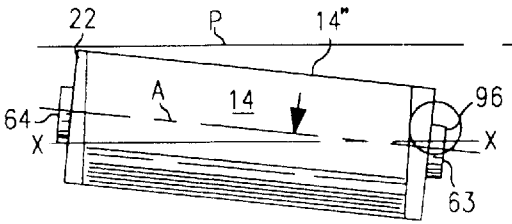
PRIOR ART FIG. 6D

An earlier prior-art pump-handle-tilt steering is shown in FIGS. 6D, 6E and 6F. This pump-handle-tilt steering is accomplished by tilting through an angle θ a pulley-drum rotational axis A by pivoting this drum axis about a steering axis 96-in-a-circle located at one end of the exit-pulley drum. This tilting occurred in plane Y—Y which is perpendicular to the casting plane P and also is perpendicular to the X—X plane, as will be understood from FIG. 1.

In the neutral steering position of pump-handle steering, the exit-pulley drum as shown in FIG. 6E is spaced a larger distance 98 from the casting plane than spacing 94 (FIG. 6B) which occurred in see-saw steering. Consequently, as will be understood from FIG. 6E, a portion of the belt near the exit always deviated considerably more substantially from the casting plane than in FIG. 6B, thereby providing considerably less support for a downstream portion of a newly cast slab moving along the casting cavity toward the exit end D of the casting machine.

It is important to note that in see-saw-tilt steering (FIGS. 6A, 6B, and 6C) the steering pivot axis 92 remains fixed in location on the carriage. Similarly, in pump-handle-tilt steering (FIGS. 6D, 6E and 6F) the steering pivot axis 96 remains fixed in location on the carriage.

"Walking-tilt" steering as illustrated in FIGS. 7A, 7B and 7C is an improvement over "see-saw tilt" steering (FIGS. 6A, 6B and 6C) or pump-handle tilt steering (FIGS. 6D, 6E and 6F). Walking-tilt steering may be considered as analagous to human walking, This analogy with "walking" does not quite fit visually with FIGS. 7A, 7B and 7C, since the casting plane P is shown above the pulley drum 22 in these illustrations. However, by turning FIGS. 7A, 7B and 7C upside down, the characterization as analogous to walking becomes visually appreciated. "Right" and "left in what follows refers to FIGS. 7A, 7B and 7C as turned upside down.

To continue the analogy, the left foot, for example, is on the ground plane P (like in FIG. 7A) while the right foot is moved away from the ground. In FIG. 7A the belt 14 is being steered toward the inboard side of the carriage. Then, for neutral steering, the right foot returns to the ground briefly (like in FIG. 7B). In FIG. 7C, the left foot is raised while the right foot remains on the ground. In FIG. 7C the belt is being steered toward the outboard side of the carriage. When a person is walking, there is no moment when both feet are off of the ground. Similarly, in walking-tilt steering, there is no moment when both ends of a steering and tensioning pulley drum are away from the casting plane P. In other words, at least one end of the exit-pulley drum is always proximate to the casting plane P.

FIGS. 7A, 7B, and 7C show, exaggerated and simplified, the notable steering positions in a cycle of walking-mode steering. In these figures the lower-carriage tensioning pulley drum 22 is seen looking upstream at the discharge end D of the casting machine 10. One "foot," that is, either one end 82 or 84 of the tensioning pulley drum 22 is always "down." That is, there is no moment when at least ore end 82 or 84 is not proximate to the casting plane P.

FIG. 7B shows the neutral walking-tilt position. Both ends of the lower exit-pulley drum 22 advantageously rest proximate to the casting plane P, unlike the spacing 94 (FIG. 6B) or 98 (FIG. 6E) in the prior art. In FIG. 7A, the steering pivot axis 100-in-a-circle is located adjacent to the casting plane P at the inboard end 84 of the exit-pulley drum 22, while this pulley is tilted in the direction there shown for steering a revolving belt 14 toward the inboard side of the carriage. When steering toward the outboard side as in FIG. 7C, the steering pivot axis 102-in a circle is completely shifted to the opposite end of the pulley drum so that this steering pivot axis 102 now is located at the outboard end 82 of the pulley drum 22 while the pulley drum is tilted in the direction shown in FIG. 7C. The great benefit achieved as shown in FIGS. 7A, 7B and 7C is that an exit portion of the casting belt 14 is separated only minimally from the casting plane P.

Inviting attention back to FIGS. 2, 3, 4 and 5, inboard and outboard steering cylinders 106 and 108 (only 108 is seen in FIG. 3) are anchored by a pivot 110 to the carriage frame 21. These steering cylinders (106, 108) have piston rods 112 which are pivotally connected at 114 to levers 116, which are levers of the first class. That is, a lever 116 pivots about a fulcrum pin 118 which is fixed in the lower carriage frame 21. The other end of steering lever 116 carries a spherical bushing 60. Thus, actuation of steering cylinder 108 extends or retracts its piston rod 112, thereby causing steering lever 116 to swing about its fixed pivot 118. Clearance for this swinging steering motion of lever 116 is provided at 119. Extending piston rod 112 moves the spherical bushing 60 and thereby moves the steering pivot axis S downwardly in FIG. 3 away from the casting plane, and vice versa when piston rod 112 is retracted. Upward and downward motion of spherical bushing 60 lifts or lowers movable bearing housing 54 or its inboard equivalent (not shown). Through tapered-roller bearings 58 (FIGS. 4 and 5), one or the other journal 63 or 64 of the exit-pulley drum is correspondingly raised or lowered, to provide the walking-tilt steering action (FIGS. 7A, 7B and 7C) upon a revolving casting belt 14.

Walking-tilt belt steering as here described provides an additional advantageous effect, namely, a relatively undisturbed casting region so far as disturbance might result from a transverse component of tilt-steering action. In the prior art as shown in FIGS. 6A to 6F, the tilting-steering action generally caused significant right-left movement in the X-plane as at 14" and hence some distortion of the casting belt in plane P where it touched the steering pulley drum at 14".

The problem is mainly solved in walking-tilt steering as above exemplified in which the casting belt, where it lies in casting plane P near an exit-pulley drum at 14'" (FIGS. 3, 7A, 7B and 7C), is advantageously hardly shifted transversely during the action of belt steering, i.e., hardly to either right or left in the X plane. This result follows from the fact that an exit-pulley drum 22 or 18 in the present invention is not transversely constrained anywhere along axis A, but rather its floating bearing housings 54, 56 are constrained by spherical bushing 60 captured within steering link 116 which in turn is captured transversely on solidly affixed pivot pin 118 in carriage frame 21. Hence, the pivot point for tilting in plane Y (FIGS. 3, 7A to 7C) is at spherical bushing 60 which is at the relatively slight distance d from casting plane P, not the greater distance R that reaches to axis A, which greater distance would result in significant sideways troublesome belt movement at point 14''' during steering. Therefore, the tilting action of an exit-pulley drum during steering of the casting belt can move the belt sideways only minimally at point 14''' where the belt lies in plane P near the pulley drum. Forestalled thereby is what otherwise would be the buildup of harmful diagonal stresses, hence distortion and fluting of the belt in the casting region to develop during the operation of the steering mechanism. The belt remains in better contact with the cast product, thereby improving the speed of casting and the quality of the cast product.

Belt position sensors as described in U.S. Pat. No. 4,940,076 of Desautels and Kaiser measure sideways drift of a revolving belt 14 and provide an electrical signal which is fed to the controller. Position-sensing potentiometers 120 (FIG. 3, only one such potentiometer is seen in FIG. 3) mounted on fixed members 122 in the carriage and having an electrical lead 124 measure upward and downward position of the driven end of each steering lever 116. This information is sent to the same electrical controller unit that handles the control of belt tensioning as discussed earlier; this programmable logic controller is operated with software which employs proportional integral-differential programs. These programs are known to those skilled in the art of process control.

A computer informational program allows display, monitoring and adjustment of the variables mentioned herein, while at the same time affording a data collection system for tuning, troubleshooting, and maintenance of not only tensioning and steering but all parameters involved in operating the casting machine and its associated equipment.

The slight steering action provided by skewing a tensioning pulley drum in a plane parallel with the plane of the casting plane has been called coplanar-skew steering. It was described and claimed in U.S. Pat. No. 4,901,785 of Dykes, Daniel and Wood. On occasion, it can be advantageously used in combination with walking-tilt steering with suitable coordination by the electrical controller unit.

In summary, as shown by the vector of motion M in FIGS. 1 and 3 originating at the outboard end of axis A of exit-pulley drum 22, the apparatus as shown and described independently moves opposite ends of an exit-pulley drum with respective vectors of motion M (only the outboard vector M being seen in FIGS. 1 and 3) wherein each vector M may have a component of motion aligned with an X—X plane (FIG. 1) parallel with the casting plane and wherein each vector M may have a component of motion aligned with a Y—Y plane (FIG. 1) perpendicular to the casting plane and wherein the component of motion aligned with the X—X plane may vary between zero and the length of the vector M and wherein the component of motion aligned with the Y—Y plane may vary between zero and the length of the vector M. There also is a vector of motion M (not shown) originating at the inboard end of the axis A of this exit-pulley drum 22. It is understood that apparatus as described independently moves opposite ends of the upper exit-pulley drum 18 with respective vectors of motion similar to those as already described for the outboard and inboard ends of the lower exit-pulley drum 22.

Although a specific presently preferred embodiment of the invention has been disclosed herein in detail, it is to be understood that this example of the invention has been described for purposes of illustration. This disclosure is not to be construed as limiting the scope of the invention, since the described methods and apparatus may be changed in details by those skilled in the art of continuous casting of metals, in order to adapt these methods to be useful in particular casting machines or situations, without departing from the scope of the following claims. For instance, the foregoing discussion has been in terms of a twin-belt casting machine, whereas the invention may be embodied in single-belt casters having a relatively flat casting region.

We claim:

1. Apparatus for steering, for tensioning and for driving a revolving casting belt in a twin-belt-type continuous metal-casting machine wherein upper and lower flexible casting belts are revolved in respective upper and lower oval paths defining a moving-mold casting region between the upper and lower revolving casting belts, said moving-mold casting region extending from an entrance of the machine to an exit of the machine, said moving-mold casting region moving in a downstream direction from said entrance of the machine to said exit of the machine defining a casting plane P extending from the entrance to the exit of the machine and wherein said upper and lower revolving casting belts travel around respective upper and lower exit-pulley drums positioned near the exit of the machine, each exit pulley drum having a rotational axis with first and second journals concentric with the rotational axis and being at opposite ends of the exit pulley drum, said apparatus for steering, for tensioning and for driving a revolving casting belt comprising:

a first steering assembly connected with a first journal for tilting an exit-pulley drum to an angle θ in a plane Y—Y which is generally perpendicular to the casting plane P for moving a first end of said exit-pulley drum away from said casting plane P while a second end of said exit-pulley drum remains proximate to the casting plane P when a belt requires steering in a first direction away from said first end;

a second steering assembly connected with a second journal for tilting said exit-pulley drum to an angle θ in said plane Y—Y for moving the second end of said exit-pulley drum away from said casting plane P while the first end of said exit-pulley drum remains proximate to the casting plane P when said belt requires steering in a second direction away from said second end;

a first tensioning assembly for applying a first force acting substantially parallel with said casting plane P in direction away from said entrance and being applied to said first journal for moving said first end of the exit-pulley drum away from the entrance in a direction substantially parallel with said casting plane P for tensioning said belt;

a second tensioning assembly for applying a second force acting substantially parallel with said casting plane P in a direction away from said entrance and being applied to said second journal for moving said second end of the exit-pulley drum away from the entrance in a direction substantially parallel with said casting plane P for tensioning said belt; and rotary drive means connected to a journal of said exit-pulley drum for rotating said exit-pulley drum for moving a casting belt in an oval path passing around said exit-pulley drum with said belt travelling along said moving-mold casting region in the downstream direction from the entrance to the exit.

2. Apparatus as claimed in claim 1, further comprising:

apparatus for moving said exit-pulley drum in simulation of an exit-pulley drum having a rigid squaring shaft for said exit-pulley drum.

3. Apparatus as claimed in claim 1, further comprising:

apparatus for moving said exit-pulley drum in simulation of an exit-pulley drum having a flexible squaring shaft for said exit-pulley drum.

4. Apparatus as claimed in claim 1, wherein a revolving casting belt has two edges and each of said edges has a circumferential length, further comprising:

apparatus for compensating for difference in the circumferential lengths of the two edges of said casting belt, said lengths being compared at the two edges of said casting belt.

5. Apparatus as claimed in claim 1, further comprising:

apparatus adjustable for compensating for built-in deviations in the machining of the mechanically effective length dimensions of said casting machine.

6. Apparatus as claimed in claim 1, further comprising:

tensioning apparatus coordinated with said steering apparatus for adjusting relative magnitudes of said first and second forces for optimizing steering of the belt.

7. A belt-type continuous metal-casting machine comprising a mold region defined by a generally straight casting plane with an exit-pulley drum having a rotational axis with a journal at each end of the exit-pulley drum concentric with the axis, and around the exit-pulley drum revolves an endless flexible casting belt which courses through the mold region travelling along the casting plane in a longitudinal direction from an entrance into the mold region to an exit therefrom, comprising:

apparatus independently moving the journals at opposite ends of said exit-pulley drum for moving the respective ends of the exit-pulley drum with respective vectors of displacement M wherein each displacement N may have a component of displacement aligned with an X—X plane parallel with the casting plane and wherein each displacement M may have a component of displacement toward and away from the casting plane and wherein the component of displacement aligned with the X—X plane may vary between zero and the length of said displacement M and wherein the component of displacement toward and away from the casting plane may vary between zero and the length of said displacement M.

8. Apparatus as claimed in claim 7, wherein:

said exit-pulley drum has a hollow cylindrical configuration concentric with said rotational axis;

first and second end bells are secured respectively to opposite ends of said exit-pulley drum;

said journals comprise first and second stub shafts secured respectively to said first and second end bells;

said first and second stub shafts are concentric with said rotational axis and project outwardly from said first and second end bells; and rotational drive mechanism is coupled to said first stub shaft for rotating said exit-pulley drum about said rotational axis.

9. Apparatus as claimed in claim 8, wherein:

the casting belt revolves around a carriage;

first and second movable housings rotatably support respectively said first and second stub shafts;

first and second steering levers of the first class are pivotally mounted on said carriage by respective pivot pins intermediate of upstream and downstream ends of said first and second steering levers;

said steering levers are oriented generally parallel with said casting plane;

said pivot pins are mounted on the carriage at respective positions which are equally spaced from the casting plane, and said positions of the pivot pins are closer to said casting plane than said rotational axis of the exit-pulley drum;

said first and second movable housings are carried by first and second spherical bushings mounted respectively near the downstream ends of said first and second steering levers;

first and second steering drive mechanisms mounted on said carriage are connected respectively to said first and second steering levers near the upstream ends of said first and second steering levers;

said first and second steering drive mechanisms selectively move the upstream ends of the first and second steering levers toward and away from the casting plane for selectively moving the movable housings away from and toward the casting plane for steering a revolving casting belt;

first and second belt-tensioning drive mechanisms are mounted on said carriage;

said first and second belt-tensioning drive mechanisms are connected respectively by third and fourth spherical bushings to said first and second movable housings;

said third and fourth spherical bushings are respectively positioned generally on an opposite side of the rotational axis of the exit-pulley drum from positions of said first and second spherical bushings; and said first and second belt-tensioning drive mechanism selectively move said first and second movable housings downstream by swinging the first and second movable housings respectively around the first and second spherical bushings.

10. Apparatus as claimed in claim 9, wherein:

said cylindrical exit-pulley drum has an outer radius R from its axis of rotation;

said first and second spherical bushings have first and second axes S;

in a neutral steering position of the first and second steering levers, said axes S are equally positioned at a distance d from the casting plane; and said distance d is equal to or less than about 30 percent of the radius R.

11. In a belt-type continuous metal-casting machine having an entrance and an exit and comprising a mold region defined by an approximately straight casting plane and comprising an exit-pulley drum rotatable around an axis A, and around the exit pulley drum passes an endless flexible casting belt which courses through the mold region travelling along the casting plane in a longitudinal direction from the entrance to the exit, and wherein the exit-pulley drum has a shaft concentric with axis A and projecting from opposite ends of the exit-pulley drum, apparatus comprising:

a first tensioning assembly for applying a first force acting substantially parallel with said casting plane in a direction away from said entrance and being applied to the shaft at a first end of said exit-pulley drum for moving said first end away from the entrance in a direction substantially parallel with said casting plane for tensioning said belt;

a second tensioning assembly for applying a second force acting substantially parallel with said casting plane in a direction away from said entrance and being applied to the shaft at a second end of said exit-pulley drum for moving said second end away from the entrance in a direction substantially parallel with said casting plane for tensioning said belt;

a rotary drive coupled to the shaft at one end of the exit-pulley drum rotating the exit-pulley drum around the axis A for driving the casting belt through the mold region travelling along the casting plane in the longitudinal direction from the entrance to the exit;

first steering mechanism coupled to the shaft at the first end of the exit-pulley drum moving the first end of the exit-pulley drum away from the casting plane while the second end of the exit-pulley drum remains proximate to the casting plane; and second steering mechanism coupled to the shaft at the second end of the exit-pulley drum moving the second end of the exit-pully drum away from the casting plane while the first end of the exit-pulley drum remains proximate to the casting plane.

12. Apparatus as claimed in claim 11, wherein:

said first and second tensioning assemblies are selectively operable for simulating movement of an exit-pulley drum having a rigid squaring shaft extending therethrough.

13. Apparatus as claimed in claim 11, wherein:

said first and second tensioning assemblies are selectively operable for simulating movement of an exit-pulley drum having a torsionally flexible squaring shaft extending therethrough.

14. Apparatus as claimed in claim 11, wherein:

said exit-pulley drum has a hollow cylindrical configuration concentric with said rotational axis A;

first and second end bells are secured respectively to said first and second ends of said exit-pulley drum;

the shaft comprises first and second stub shafts secured respectively to said first and second end bells;

said first and second stub shafts are concentric with said rotational axis A and project outwardly from said first and second end bells;

the rotary drive comprises rotational drive mechanism coupled to said first stub shaft for rotating said exit-pulley drum about said rotational axis A; and said first and second tensioning assemblies respectively serve to apply said first and second forces to said first and second stub shafts.

15. Apparatus as claimed in claim 14, wherein:

the casting belt revolves around a carriage;

first and second movable housings rotatably support respectively said first and second stub shafts;

first and second steering levers of the first class are pivotally mounted on said carriage by respective pivot pins intermediate of upstream and downstream ends of said first and second steering levers;

said steering levers are oriented generally parallel with said casting plane;

said pivot pins are mounted on the carriage at respective positions which are equally spaced from the casting plane, and said positions of the pivot pins are closer to said casting plane than said rotational axis of the exit-pulley drum;

said first and second movable housings are carried by first and second spherical bushings mounted respectively near the downstream ends of said first and second steering levers;

first and second steering drive mechanisms mounted on said carriage are connected respectively to said first and second steering levers near the upstream ends of said first and second steering levers;

said first and second steering drive mechanisms selectively move the upstream ends of the first and second steering levers toward and away from the casting plane for selectively moving the movable housings away from and twoard the casting plane for steering a revolving casting belt;

first and second tensioning assemblies are mounted on said carriage;

said first and second tensioning assemblies are connected respectively by third and fourth spherical bushings to said first and second movable housings;

said third and fourth spherical bushings are respectively positioned generally on an opposite side of the rotational axis of the exit-pulley drum from positions of said first and second spherical bushings; and said first and second tensioning assemblies selectively move said first and second movable housings downstream by swinging the first and second movable housings respectively around the first and second spherical bushings.

16. Apparatus as claimed in claim 15, wherein:

said cylindrical exit-pulley drum has an outer radius R from its axis of rotation:

said first and second spherical bushings have first and second axes S;

in a neutral steering position of the first and second steering levers, said axes S are equally positioned at a distance d from the casting plane; and said distance d is equal to or less than about 30 percent of the radius R.

17. Apparatus as claimed in claim 11, in which:

said first and second tensioning assemblies are selectively operable for compensating for built-in deviations in the machining of the mechanically effective length dimensions of said casting machine.

18. Apparatus carrying a journal of an exit-pulley drum having a rotational axis A aligned with the journal and having a radius R for steering and tensioning a revolving casting belt travelling in a downstream direction along a casting plane in a continuous casting machine, said apparatus comprising:

a carriage frame;

a steering lever having a fixed pivot anchored to the frame;

said fixed pivot having an axis T parallel with said casting plane and perpendicular to said downstream direction;

a steering actuating mechanism connected to the steering lever for swinging the steering lever around said fixed pivot;

a spherical steering bushing mounted on a downstream end of said steering lever providing a steering axis S positioned at a distance D from said rotational axis A, said distance D being measured toward the casting plane in a direction perpendicular to the casting plane, said distance D being at least about 70% of said radius R;

said steering axis S being moved by said steering lever toward and away from the casting plane by operation of said steering actuating mechanism;

a movable housing having a bearing rotatably supporting the journal of the exit-pulley drum;

said movable housing being carried by said spherical steering bushing and being moved toward and away from the casting plane by movement of said steering axis S toward and away from the casting plane for moving the journal of the exit-pulley drum toward and away from the casting plane for steering the revolving belt;

another spherical bushing being mounted on the movable housing and being located generally on the opposite side of said rotational axis A from said spherical steering bushing; and a belt-tensioning actuating mechanism mounted on the carriage frame and being connected to said other spherical bushing for swinging the movable housing in a downstream direction for tensioning the belt by swinging the movable housing around the steering axis S.

19. Apparatus as claimed in claim 18, in which:

said belt-tensioning actuating mechanism is coordinated with said steering actuating mechanism for optimizing steering of the belt.

20. A method of steering a revolving casting belt in a belt-type continuous metal-casting machine having a mold region defined by a substantially straight casting plane and including an exit-pulley drum around which revolves an endless flexible casting belt which travels along the casting plane in a downstream direction, the method of steering the revolving casting belt comprising the following steps:

while keeping a first end of said exit-pulley drum proximate to the casting plane, moving a second end of said exit-pulley drum away from said casting plane in a direction in a plane Y—Y which is perpendicular to the casting plane thereby tilting the exit-pulley drum in said plane Y—Y at an angle θ to the casting plane when the revolving belt requires to be steered in a first direction; and while keeping the second end of said exit-pulley drum proximate to the casting plane, moving the first end of said exit-pulley drum away from said casting plane in a direction in said plane Y—Y thereby tilting the exit-pulley drum in said plane Y—Y at an angle θ to the casting plane when the revolving belt requires to be steered in a second direction opposite to said first direction.

21. A method of steering a revolving casting belt as claimed in claim 20, including:

moving the first end of the exit-pulley drum away from the casting plane by swinging the exit-pulley drum around a first steering axis positioned at the second end of the exit-pulley drum; and moving the second end of the exit-pulley drum away from the casting plane by swinging the exit-pulley drum around a second steering axis positioned at the first end of the exit-pulley drum.

22. The method of steering a revolving casting belt as claimed in claim 21, wherein the exit-pulley drum has an axis of rotation A and a radius R, including:

positioning said first steering axis at a distance d from the casting plane, said distance d being no more than about 30 percent or less of said radius R; and positioning said second steering axis at a distance d from the casting plane, said distance d being no more that about 30 percent or less of said radius R.

23. A method of steering a revolving casting belt as claimed in claim 22, including:

providing a neutral steering position for the exit-pulley drum wherein both ends of the exit-pulley drum are proximate to the casting plane; and in said neutral steering position of the exit-pulley drum, placing said first and second steering axes in a Y—Y plane which is aligned with and passes through said axis of rotation A and which is perpendicular to said casting plane P.

24. A method of steering a revolving endless flexible casting belt in a belt-type continuous casting machine wherein a mold region is defined by the casting belt travelling in a downstream direction along a casting plane, said method comprising:

revolving the casting belt by rotatably driving an exit-pulley drum positioned near a downstream end of the mold region;

moving in a plane Y—Y which is perpendicular to the casting plane a first end of the exit-pulley drum, said moving in said plane Y—Y of said first end being in a direction away from the casting plane;

keeping a second end of the exit-pulley drum proximate to the casting plane while moving said first end for steering the revolving casting belt in a first direction;

moving in said plane Y—Y a second end of the exit-pulley drum, said moving in said plane Y—Y of said second end being in a direction away from the casting plane; and keeping the first end of the exit-pulley drum proximate to the casting plane while moving said second end for steering the belt in a second direction opposite to said first direction.

25. A method as claimed in claim 24, wherein said exit-pulley drum has an axis of rotation with its belt-contacting surface being at a radius R from said axis, and the method includes the steps of:

revolving the casting belt by rotatably driving the exit-pulley drum around its axis of rotation;

steering the revolving casting belt in said first direction by moving the first end of the exit-pulley drum away from the casting plane and keeping a second end of the exit-pulley drum proximate to the casting plane and tilting the axis of rotation of the exit-pulley drum in a plane generally perpendicular to the casting plane; and steering the revolving casting belt in said second direction by moving the second end of the exit-pulley drum away from the casting plane and keeping the first end of the exit-pulley drum proximate to the casting plane and tilting the axis of rotation of the exit-pulley drum in the plane generally perpendicular to the casting plane.

26. The method as claimed in claim 25, wherein:

the first end of the exit-pulley drum is moved away from the casting plane and the second end of the exit-pulley drum is kept proximate to the casting plane by tilting the axis of rotation of the exit-pulley drum about a first steering axis positioned adjacent to the second end of the exit-pulley drum at a first distance d from the casting plane wherein said first distance d is no more that about 30 percent or less of the radius R; and wherein:

the second end of the exit-pulley drum is moved away from the casting plane and the first end of the exit-pulley drum is kept proximate to the casting plane by tilting the axis of rotation of the exit-pulley drum about a second steering axis adjacent to the first end of the exit-pulley drum at a second distance d from the casting plane wherein said second distance d is no more than about 30 percent or less of the radius R.

* * * * *